US005293850A

United States Patent [19]

Nishida

[11] Patent Number: 5,293,850

[45] Date of Patent: Mar. 15, 1994

[54] SCROLL TYPE ROTARY INTERNAL COMBUSTION ENGINE

[75] Inventor: Mitsuhiro Nishida, Fukuoka, Japan

[73] Assignee: Mitsubishi Denki Kabushiki Kaisha, Tokyo, Japan

[21] Appl. No.: 920,843

[22] Filed: Jul. 28, 1992

[30] Foreign Application Priority Data

Jul. 29, 1991 [JP] Japan ..... 3-188459
Jul. 30, 1991 [JP] Japan ..... 3-189859
Jul. 9, 1992 [JP] Japan ..... 4-182065

[51] Int. Cl.[5] ..... F02B 53/00
[52] U.S. Cl. ..... 123/235; 418/55.1
[58] Field of Search ..... 123/234, 235; 418/55.1

[56] References Cited

U.S. PATENT DOCUMENTS 4,192,152 3/1980 Armstrong ..... 62/402
4,677,949 7/1987 Youtie ..... 418/55.1 X
4,842,499 6/1989 Nishida et al. .
5,094,205 3/1992 Billheimer ..... 123/234 X

FOREIGN PATENT DOCUMENTS 51130 3/1984 Japan ..... 123/235
138832 6/1986 Japan .
61-190183 8/1986 Japan .

OTHER PUBLICATIONS

Patents Abstracts of Japan, Section M, vol. 11 (1987), No. 14 (M-553).

*Primary Examiner*—Michael Koczo
*Attorney, Agent, or Firm*—Sughrue, Mion, Zinn, Macpeak & Seas

[57] ABSTRACT

An internal combustion engine comprising a scroll compressor unit having a pair of scrolls interfitted to each other to define a compression chamber therebetween and a scroll expansion unit having a pair of scrolls interfitted to each other to define an expansion chamber therebetween. The compressor chamber is communicated to the compression chamber through a check valve, and a burning unit for detonating a fuel together with a working fluid in the expansion chamber to expand it thereby driving the scroll expansion unit. The scroll compressor unit and the scroll expansion unit are interconnected by an interconnecting unit.

7 Claims, 9 Drawing Sheets

SCROLL TYPE ROTARY INTERNAL COMBUSTION ENGINE

BACKGROUND OF THE INVENTION

This invention relates to an internal combustion engine and, more particularly, to a scroll-type internal combustion engine of which the compression chamber and the expansion chamber are defined by respective pairs of scrolls.

A scroll-type fluid machine having a pair of scrolls rotatably interfitted within a vessel to define a displaceable compression chamber therebetween for compressing the fluid within the vessel is disclosed, thereby to generate a vacuum within the vessel or to provide compressed fluid. One example of such fluid machine is disclosed in U.S. Pat. No. 4,842,499. Since such a rotatable scroll-type fluid machine is a rotary machine, it is smooth in operation and has less vibration and has a high efficiency and a high speed operation is possible.

Also, a rocking or orbiting scroll-type fluid machine in which a pair of stationary scrolls and an orbiting scroll is interfitted to define a displaceable volume chamber therebetween is also known in one example of the orbiting scroll-type fluid machine is described in Japanese Patent Laid-Open No. 61-190183. Such an orbiting scroll-type fluid machine has a very low vibration level and noise level and is efficient and compact as compared to the reciprocating motion engine.

Therefore, a compact, high-speed and high-efficiency prime mover low in vibration and noise levels would be obtained if the rotary or orbiting scroll-type fluid machine could be applied to a prime mover, and it is desirable to provide such prime mover.

SUMMARY OF THE INVENTION

Accordingly, one object of the present invention is to provide a scroll-type internal combustion engine.

Another object of the invention is to provide a compact, high-speed and high-efficiency internal combustion engine which utilizes a scroll-type fluid machine.

With the above objects in view, the internal combustion engine of the present invention comprises a scroll compressor unit having a pair of scrolls interfitted to each other to define a compression chamber therebetween; a scroll expansion unit having a pair of scrolls interfitted to each other to define an expansion chamber therebetween, a check valve for communicating the compression chamber to the expansion chamber and a burning unit for detonating in the expansion chamber a fuel together with a working fluid to expand it thereby driving the scroll expansion unit; and an interconnecting unit interconnecting the scroll compressor unit and the scroll expansion unit.

With this internal combustion engine, the scroll compressor unit and the scroll expansion unit are operated in the interconnected relationship, so that the a compact high efficient internal combustion engine which has a low vibration level and a high efficiency can be obtained.

The internal combustion engine of the present invention may comprise a scroll compressor unit having a pair of stationary and orbiting scrolls relatively rockably interfitted to each other to define a compression chamber therebetween; and a orbiting-type scroll expansion unit having a pair of stationary and orbiting scrolls relatively rockably interfitted to each other to define an expansion chamber therebetween, a check valve for communicating the compression chamber to the expansion chamber, and a burning unit for detonating, in the expansion chamber, a fuel together with a working fluid to expand it thereby driving the scroll expansion unit; the orbiting scroll of the scroll compressor unit and the orbiting scroll of the scroll expansion unit being integrally connected to each other.

In this internal combustion engine, the scroll compressor unit and the scroll expansion unit are orbiting type, the engine operation can be made smoothly at a high-speed.

Alternatively, the internal combustion engine of the present invention may comprise a rotary-type scroll compressor unit having a pair of rotatable scrolls relatively rockably interfitted to each other to define a compression chamber therebetween; and a rotary-type scroll expansion unit having a pair of rotatable scrolls relatively rockably interfitted to each other to define an expansion chamber therebetween, a check valve for communicating the compression chamber to the expansion chamber and a burning unit for detonating, in the expansion chamber, a fuel together with a working fluid to expand it thereby driving the rotary-type scroll expansion unit; and a rotary shaft for co-axially rotatably supporting the scroll compressor unit and the scroll expansion unit.

In this internal combustion engine, the scroll compressor unit and the scroll expansion unit are rotary type, so that a smooth high-speed operation can be achieved with a relatively small number of parts.

The internal combustion engine may comprise a scroll compressor unit having a pair of scrolls interfitted to each other to define a compression chamber therebetween for compressing a working fluid to provide a compressed inflammable gas; a scroll expansion unit having a pair of scrolls interfitted to each other to define an expansion chamber communicated to the compression chamber through a check valve for receiving the compressed inflammable gas and an ignition unit for detonating and expanding, in the expansion chamber, the compressed inflammable gas, thereby to move the scrolls of the scroll expansion unit relative to each other; and an interconnecting unit interconnecting the scroll compressor unit and the scroll expansion unit.

With this internal combustion engine, since the burning gas is ignited by the ignition unit, the structure is simple and compact and a smooth, high-speed operation can be achieved.

The internal combustion engine may alternatively comprise a scroll compressor unit having a pair of scrolls interfitted to each other to define a compression chamber therebetween for compressing a working fluid to provide a high-temperature compressed working fluid; a scroll expansion unit having a pair of scrolls interfitted to each other to define an expansion chamber communicated to the compression chamber through a check valve for receiving the high-temperature compressed working gas and a fuel injection unit for injecting fuel in the expansion chamber to detonate and expand the high-temperature compressed working gas, thereby to move the scrolls of the scroll expansion unit relative to each other; and an interconnecting unit interconnecting the scroll compressor unit and the scroll expansion unit.

In this internal combustion engine, fuel is injected into the high-temperature working fluid, so that the structure is simple and compact and a smooth, high-speed, high-efficiency operation can be achieved.

BRIEF DESCRIPTION OF THE DRAWINGS

The present invention will become more readily apparent from the following detailed description of the preferred embodiments of the present invention taken in conjunction with the accompanying drawings, in which.

DESCRIPTION OF THE PREFERRED EMBODIMENTS

Figure 1:
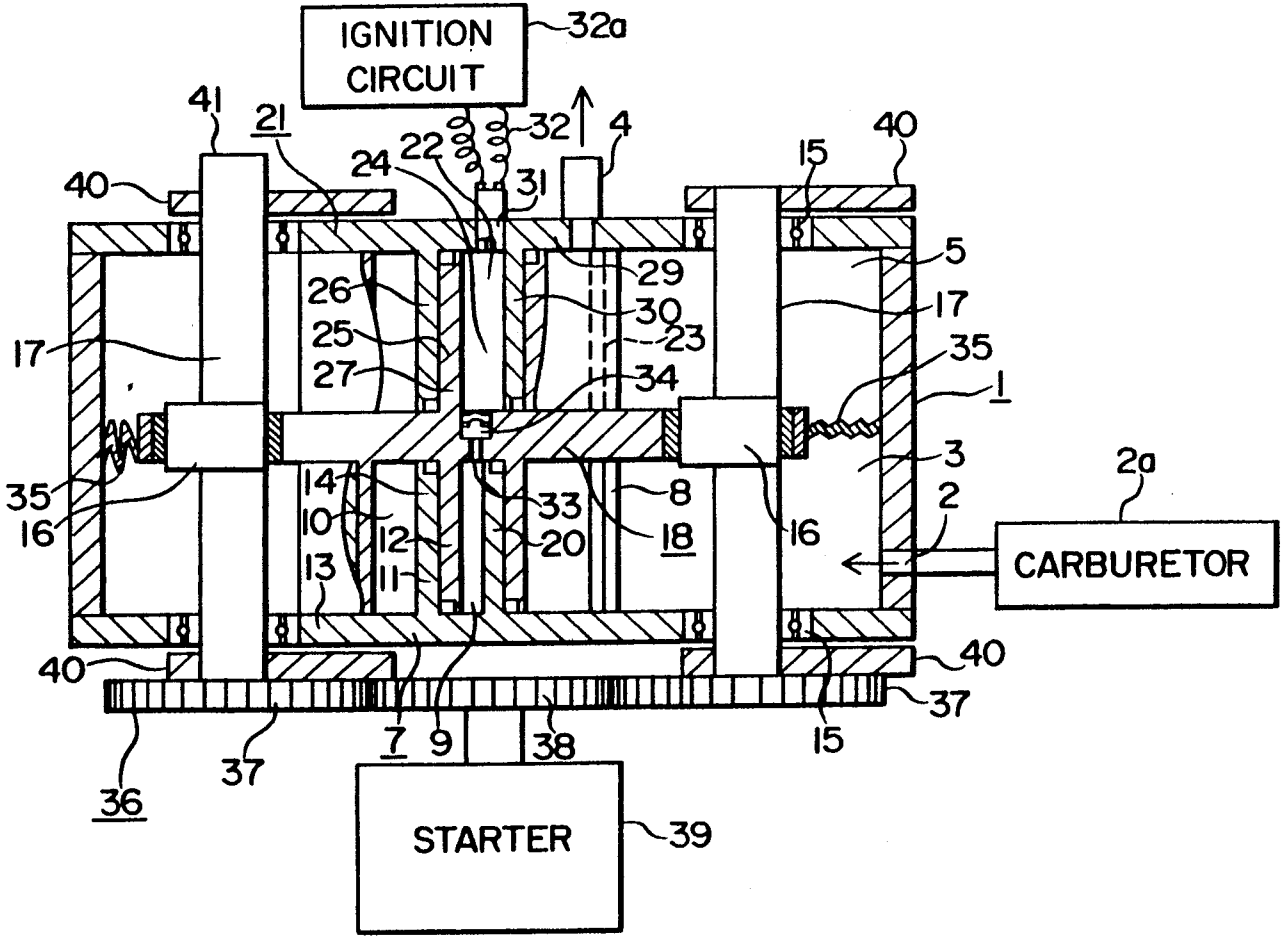
FIG. 1 is a schematic sectional view illustrating the rocking scroll-type internal combustion engine of one embodiment of the present invention.
Figure 2:
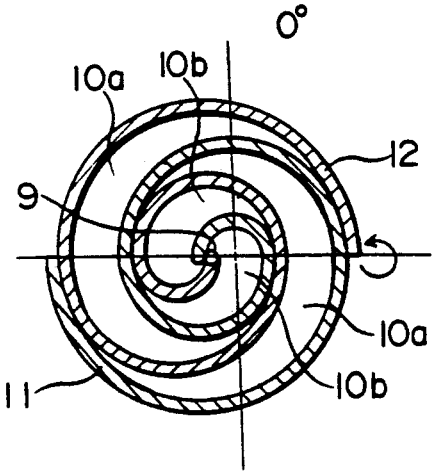
FIG. 2 is an operational diagram illustrating the scroll compressor unit shown in FIG. 1 at the initial stage of the compression stroke.
Figure 3:
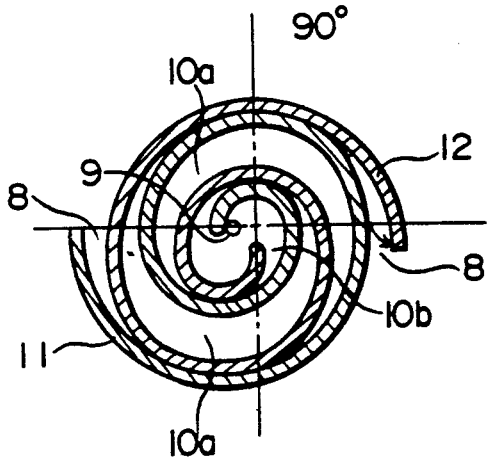
FIG. 3 is an operational diagram illustrating the scroll compressor unit rotated by 90° from the position shown in FIG. 2.
Figure 4:
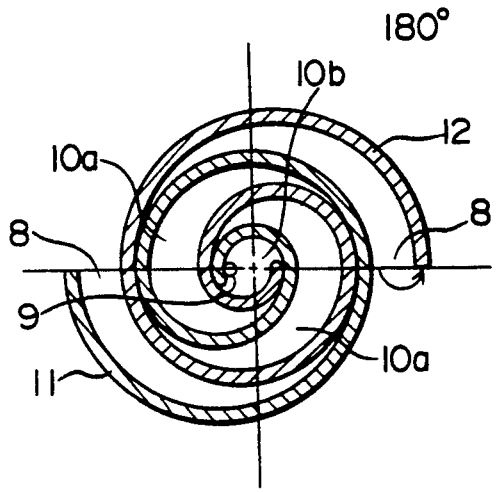
FIG. 4 is an operational diagram illustrating the scroll compressor unit rotated by 180° from the position shown in FIG. 2.
Figure 5:
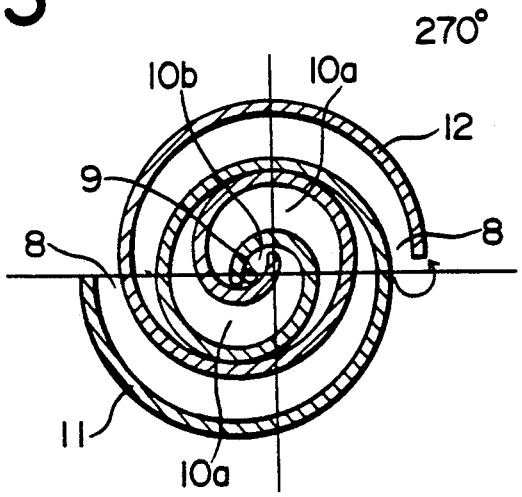
FIG. 5 is an operational diagram illustrating the scroll compressor unit rotated by 270° from the position shown in FIG. 2.

FIG. 1 illustrates the internal combustion engine of the present invention which comprises a housing 1 having defined therein a compressor unit chamber 3 having an intake port 2 and an expansion unit chamber 5 having an exhaust port 4. The intake port 2 has connected thereto a carburetor 2*a* for forming, for example, an air-and-gasoline mixture, and a or orbiting-type scroll compressor unit 7 is disposed within the compressor unit chamber 3 for compressing the inflammable gas such as the air-to-fuel mixture supplied from the intake port 2 to form a compressed inflammable gas. The scroll compressor unit 7, which may be of any known type disclosed in Japanese Patent Laid-Open No. 61-190183 for example and of which basic structure and the operation are illustrated in FIGS. 2 to 7, comprises a pair of scrolls 11 and 12 of identical involute curve or the like. The pair of scrolls 11 and 12 are interfitted with each other so that compression chambers 10*a* and 10*b* having an inlet 8 and an outlet 9 are defined between the scrolls 11 and 12. The first scroll 11 is a stationary scroll comprising a base plate 13 which is a side wall of the housing 1 and a spirally wound plate-like scroll member 14 secured to the base plate 13. The second scroll 12 comprises a rocking or orbiting base plate 18 rockably supported on an eccentric cam 16 secured to a rotary shaft 17 rotatably supported by bearings 15 on the housing 1 and a spirally wound plate-like scroll member 20 extending from the rocking base plate 18 toward the first scroll 11. The orbiting scroll 12 is moved in a rocking or orbited motion without changing its orientation as shown in FIGS. 2 to 5 by the camming action of the eccentric cam 16, so that the inflammable gas is suctioned through the radially outer inlet 8 into the arcuated compression chamber 10 formed between the scroll members 14 and 20, the inflammable gas is then compressed in the compressed chamber 10 as it is moved radially inwardly toward the center along the scroll members as the second scroll 12 rocks, whereby a compressed inflammable gas is supplied from the outlet 9 formed in the rocking base plate 18.

Disposed within the expansion unit chamber 5 is a orbiting-type scroll expansion unit 21 of a structure similar to the scroll compressor unit 7. The scroll expansion unit 21 comprises a pair of scrolls 25 and 26 of the identical involute curve or the like. The pair of scrolls 25 and 26 are interfitted with each other so that expansion chambers 24 having an inlet 22 and an outlet 23 are defined between the scrolls 25 and 26. The third scroll 25 comprises a scroll member 27 disposed on the base plate 18 common to that of the scroll compressor unit 7, and the fourth scroll 26 comprises a base plate 29 which is a side wall of the housing 1 and a spirally wound plate-like scroll member 30 secured to the base plate 29. The rocking or orbiting scrolls 12 and 25 of the of the scroll compressor unit 7 and the scroll expansion unit 21 are coaxially mounted on the common rocking base plate 18 and make a rocking or orbital motion in the same direction but their winding direction is opposite to each other. Also, the scroll expansion unit 21 comprises an ignition plug 31 which is a burning unit disposed within the expansion chamber 24 for igniting and expanding (detonating) the compressed inflammable gas, so that the detonting of the inflammable gas causes the scroll expansion unit 21 to be rockingly driven. The ignition plug 31 is connected to an ignition circuit 32*a* by conductors 32.

The common rocking base plate 18 common to the second scroll 12 and the third scroll 25 has formed therein a communication passage 33 through which the outlet 9 of the scroll compressor unit 7 is connected to the inlet 22 of the scroll expansion unit 21. Within the communication passage 33, a check valve 34 which allows the compressed inflammable gas from the scroll compressor unit 7 to flow only in the direction toward the scroll expansion unit 21. A substantially annular, radially expandable bellows 35 is welded between the circumference of the rocking base plate 18 and the casing 1, so that the bellows 35 together with the rocking base plate 18 hermetically divides the internal space of the casing 1 into the compressor unit chamber 3 and the expansion unit chamber 5.

The internal combustion engine also comprises an interlocking unit disposed between the scroll compressor unit 7 and the scroll expansion unit 21. In this embodiment, the interlocking unit is the rocking base plate 18 common to the rocking scroll 12 of the scroll compressor unit 7 and the rocking scroll 25 of the scroll expansion unit 21. An interlocking mechanism 36 is disposed on both ends of the rocking base plate 18 for maintaining the posture or the orientation of the rocking base plate 18. The interlocking mechanism 36 in this embodiment comprises gears 37 mounted to one end of each rotary cam shaft 17 for making the rocking motion of the base plate 18 common to the scroll compressor unit 7 and the scroll expansion unit 21 and a gear 38 in engagement with the gears 37 so that the rotary cam shafts 17 at the opposite ends of the rocking base plate 18 are rotated in synchronization with each other. The gear 38 is connected to a starter 39, each of the rotary cam shaft 17 is provided with a counter weight 40, and one end of one of the rotary cam shaft 17 is extended so that it may be utilized as an output shaft 41.

In the internal combustion engine thus constructed, the rocking scrolls 12 and 25 of the scroll compressor unit 7 and the scroll expansion unit 21 are rotated by means of the starter 39 through the interlocking mechanism 36. Then, the scroll compressor unit 7 sucks the air-fuel mixture gas which is the working fluid into the compressor unit chamber 3 through the intake port 2. The air-fuel mixture gas flows into the compression chamber 10 through the inlet 8 of the scroll compressor unit 7 and it is moved toward the central portion of the scroll and compressed as the rocking scroll 12 rocks and, when it is sufficiently compressed, it reaches the central outlet 9 and pushes open the check valve 34 by its pressure to passes through the communication passage 33 into the inlet 24 of the scroll expansion unit 21. The compressed air-fuel mixture is then ignited by the ignition plug 31 to abruptly expand and increase it pressure. This pressure is not allowed to flow back through the communication passage 33 because of the check valve 34, so that it acts on the scroll members 25 and 26 of the scroll expansion unit 21 to push and increase the volume of the expansion chamber 24. The scroll expansion unit 21 is rockably driven by this expanding gas and one portion of this driving power is utilized to drive the scroll compressor unit 7 through the third scroll 25 and the rocking base plate 18, and the remaining portion of the driving power is taken out as a rotating output power from the output end 41 of the cam shaft 17 which is a output rotary shaft through the rocking base plate 18 and the eccentric cam 16. The expanded gas radially outwardly moved within the scroll expansion unit 21 from its center is exhausted into the expansion unit chamber 5 and then to the engine exterior through the exhaust port 4.

Figure 6:
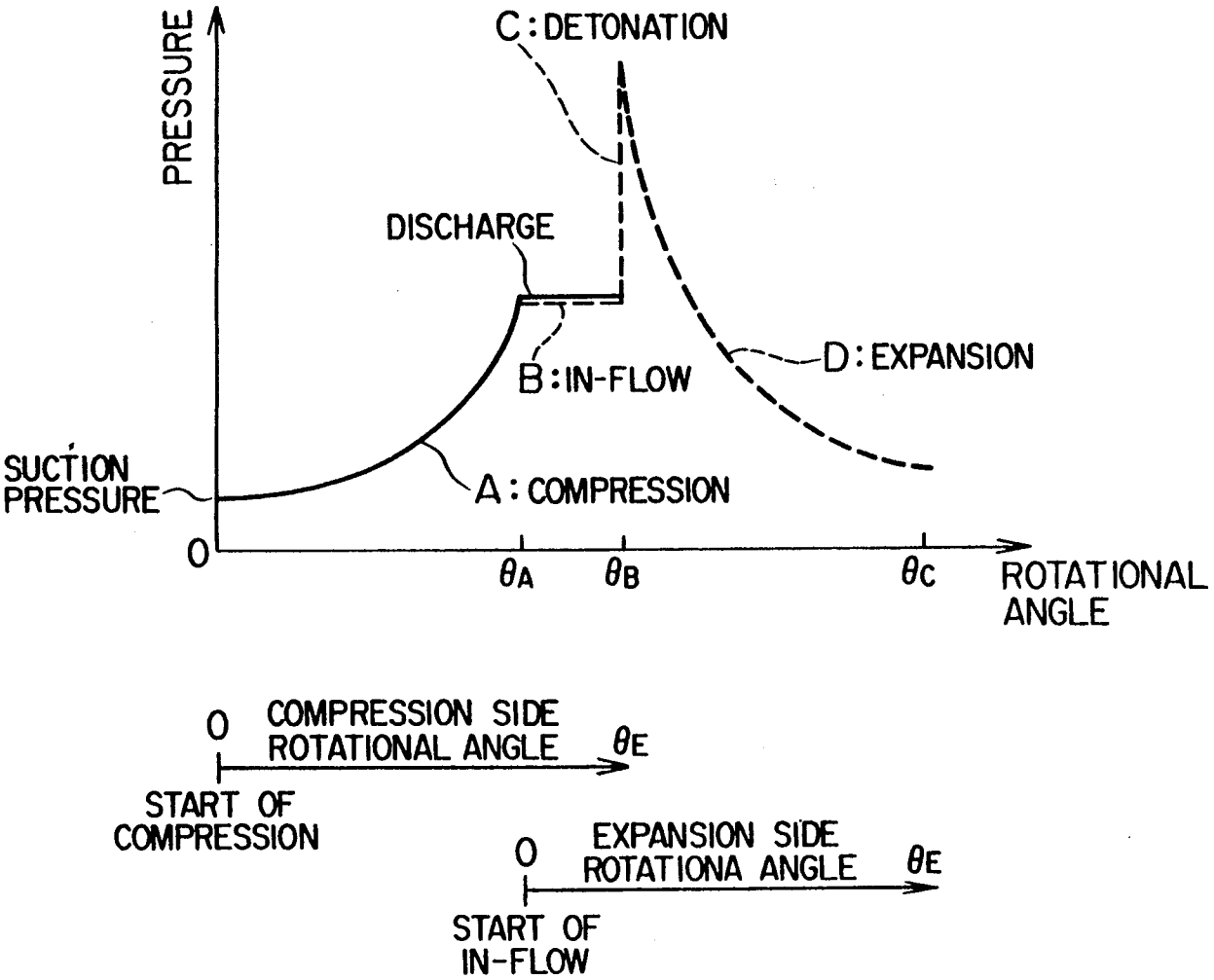
FIG. 6 is a graph showing the change in working fluid pressure relative to rotational angle of the scroll of the internal combustion engine of the present invention.

FIG. 6 is a graph illustrating the pressure of the working fluid plotted against the rotational angle of the scroll compressor unit 7 and the scroll expansion unit 21 of the internal combustion engine of the present invention. The rotation of the scroll compressor unit 7 or the scroll expansion unit 21 here means a rocking circular motion of the rocking base plate 18 caused by the rotation of the eccentric cam 16 about a circle having a radius equal to the eccentricity of the eccentric cam 16. In FIG. 6, the working fluid which is the inflammable gas within the compressor unit chamber 3 is suctioned through the inlet 8 into the compression chamber 10a defined between the pair of scrolls 11 and 12 of the scroll compressor unit 7, moved toward the center of the scroll compressor unit 7 while being compressed as the scroll compressor unit 7 rotates, so that the pressure of the inflammable gas increases as the rotation of the scroll compressor unit 7 as illustrated by a curve A in FIG. 6. When the scroll compressor unit 7 rotates by a rotation angle $\theta$ A, the pressure of the inflammable gas increases to a sufficiently high pressure and the check valve 34 between the scroll compressor unit 7 and he scroll expansion unit 21 is opened to cause the high-pressure inflammable gas to be suctioned into the scroll expansion unit 21. This is illustrated by a curve B in FIG. 6. The further rotation of the scroll compressor unit 7 causes the compressed inflammable gas to be received by the scroll expansion unit 21 and one compression stroke completes at a rotational angle $\theta$ B$=\theta$ E, which is followed by the next compression stroke.

At the angle $\theta$ A at which the check valve 16 opens, the compressed high-pressure inflammable gas is supplied from the compression chamber 10 of the scroll compressor unit 7 to the inlet 22 to the expansion chamber 24 of the scroll expansion unit 21. At a rotational angle $\theta$ B, the inflammable gas supplied to the expansion chamber 24 is ignited by the ignition plug 31 at the central region of the scroll expansion unit 21, whereupon it is detonated and abruptly increases its pressure as shown by a curve C in FIG. 6 and, as shown by a curve D in FIG. 6, the expanding gas causes the expansion chamber 24 to be expanded and the scroll expansion unit 21 to be rockingly driven as it moves to the outer peripheral region of the scroll expansion unit 21 and finally exhausted into the expansion unit chamber 5. The expansion stroke thus continues from the rotational angle $\theta$ B to the rotational angle $\theta$ C, and the expansion stroke and the expansion stroke are staggered and overlapped relative to each other by a rotational angle ($\theta$ B$-\theta$ A).

Figure 7:
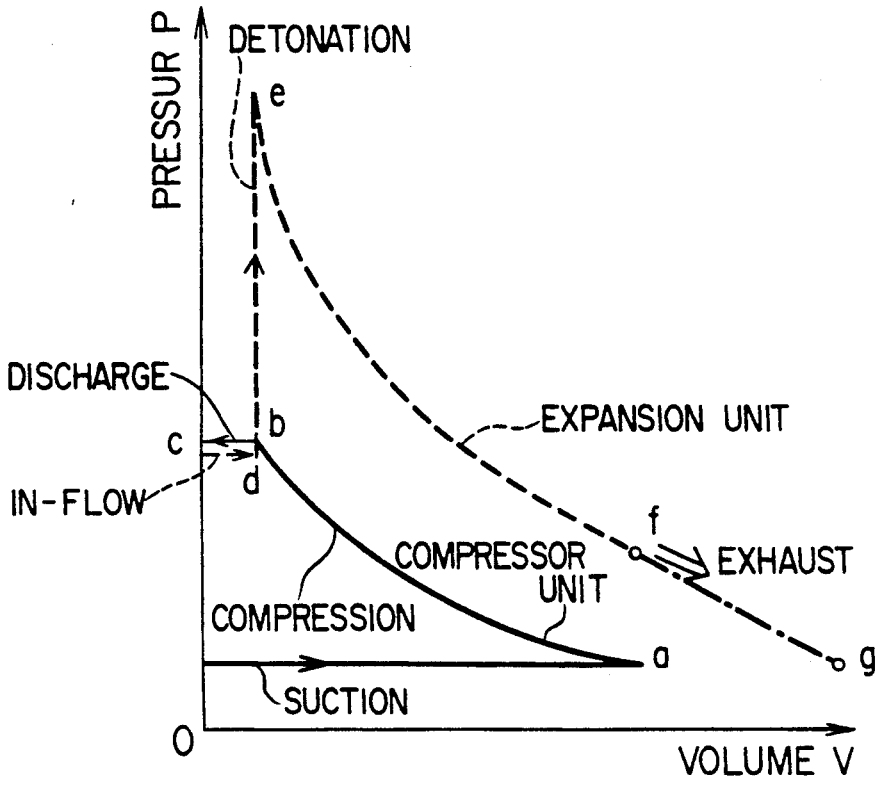
FIG. 7 is a P-V diagram of the internal combustion engine of the present invention.

FIG. 7 is a P-V diagram of the pressure and the volume of the inflammable gas in connection with the compression chamber 10 and the expansion chamber 24. As apparent from FIG. 7, the inflammable gas suctioned into the compression chamber 10 at a point a is increased in its pressure as the decrease of the volume along the curve a-b in the compression stroke, and, as it moves from the scroll compressor unit 7 to the scroll expansion unit 21 through the check valve 16 at the end of the compression stroke (the point b), its pressure and volume exhibit substantially no change as illustrated by lines b - c - d. When the inflammable gas is ignited, the pressure of the working gas very rapidly increases to a very high level without any substantial change in volume as shown by a curve d - e. Thereafter, as shown by a curve e - f, the working gas gradually decreases its pressure while causing the volume of the expansion chamber 24 of the scroll expansion unit 21 to be increased and exhausted at a point f. When the number of the turns of the scroll of the scroll expansion unit 21 is made greater than that of the scroll of the scroll compressor unit 7 so that the gas is exhausted at a point g, the energy of the working gas corresponding to a curve f - g can be recovered.

Figure 8:
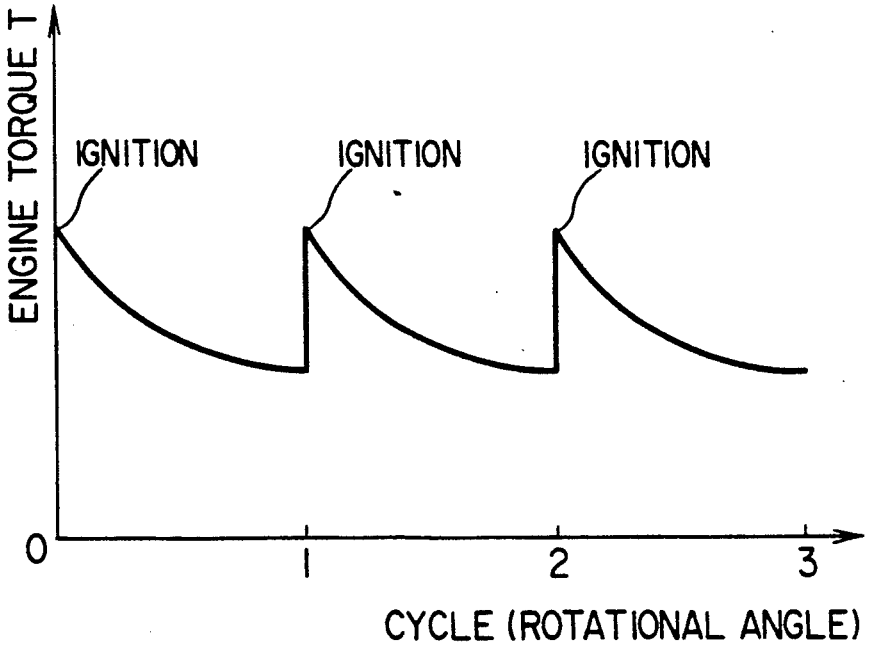
FIG. 8 is a graph showing the change in output torque generated by each expansion chamber relative to the rotational angle of the internal combustion engine of the present invention.

FIG. 8 is a graph illustrating the amount of output torque obtained from the rotary shaft 17 through the scroll from a predetermined expansion chamber 24 with respect to a cycle (rotational angle) from one detonation and the next detonation within that particular expansion chamber 24 of the internal combustion engine of the present invention. In each cycle, the output torque abruptly increases at each detonation and decreases as the rotation progresses. The above-torque is repeatedly generated for each expansion chamber 24 and, since these torques generated by the plurality of the expansion chambers 24 and due to the inertia of the engine moving parts, a torque which is very smooth for an engine torque can be obtained. The fluctuation of the engine torque is about 5%, which is easily understood from the fact that the torque fluctuation is small in the scroll compressor as is well known in the art.

FIGS. 9 to 13 illustrate another embodiment of the internal combustion engine of the present invention which comprises a housing 101 having defined therein a compressor unit chamber 104 having an intake port 103 and an expansion unit chamber 106 having an exhaust port 105. The intake port 103 of the compressor unit chamber 104 has connected thereto a carburetor **103*a* so that a working fluid which is an inflammable gas of an air-and-gasoline mixture, for example, is supplied through the intake port 103, and a scroll compressor unit 107 is disposed within the compressor unit chamber 104 for compressing the inflammable gas to form a compressed inflammable gas. The scroll compressor unit 107, which may be of any known type disclosed in Japanese Patent Laid-Open No. 61-190183 or U.S. Pat. No. 4,842,499 for example and of which basic structure and the operation are illustrated in FIGS. 10 to 13, comprises a pair of scrolls 113 and 114 of identical involute curve or the like. The pair of scrolls 113 and 114 are interfitted with each other so that compression chambers 112*a* and 112*b* having an inlet 110 and an outlet 111 are defined between the scrolls 113 and 114. The first scroll 113 comprises a rotary shaft 115, a base plate 116 supported by the rotary shaft 115 and a spirally wound plate-like scroll member 117 secured to the base plate 116. The second scroll 114 comprises a similar rotary shaft 118, a base plate 119 and a spirally wound plate-like scroll member 120 extending from the rocking base plate 119 toward the first scroll 113. These scrolls 113 and 114 are rotated in the same direction about the respective axes parallel to each other while being interfitted with each other, so that the inflammable gas is suctioned through the radially outer inlet 110 into the arcuated compression chamber formed between the scroll members 117 and 120, the inflammable gas is then compressed as it is moved radially inwardly toward the center along the scroll members, whereby a compressed inflammable gas is supplied from the outlet 111 formed in the rotary shaft 118. While the pair of scrolls are rotated as illustrated in FIGS. 10 to 13, the relative positional relationship between two scrolls are similar to that of the rocking-type illustrated in FIGS. 2 to 5**.

The rotary shaft 118 extends through a partition wall 102 of the housing 101 and is connected to the scroll expansion unit 121 disposed in the expansion unit chamber 106. The scroll expansion unit 121 has similar structure to the scroll compressor unit 107 and comprises a pair of scrolls 127 and 128 rotatably supported by bearings 122 and 123 and interfitted with each other so that expansion chambers 126 having an inlet 124 and an outlet 125 are defined between the scrolls 127 and 128. The third scroll 127 comprises a rotary shaft 118 supported by the bearing 122, a base plate 129 and a scroll member 130, and the fourth scroll 128 comprises a rotary shaft 131 which is an output shaft supported by the bearing 123, a base plate 132 and a scroll member 133. The scroll compressor unit 107 and the scroll expansion unit 121 are coaxially mounted on the common rotary shaft 118 to rotate in the same direction but their winding direction is opposite to each other. Also, the scroll expansion unit 121 comprises an ignition plug 135 which is a burning unit disposed within the expansion chamber 126 for igniting and expanding the compressed inflammable gas, so that the detonation of the inflammable gas causes the scroll expansion unit 121 to be rotatingy driven. The ignition plug 135 is connected to an ignition circuit **137*a* by conductors 137 through a slip ring 136**.

The common rotary shaft 118 which integrally connects the second scroll 114 and the third scroll 127 has formed therein a communication passage 139 through which the outlet 111 of the scroll compressor unit 107 is connected to the inlet 124 of the scroll expansion unit 121. Within the communication passage 139, a check valve 140 which allows the compressed inflammable gas from the scroll compressor unit 107 to flow only in the direction toward the scroll expansion unit 121.

The internal combustion engine of this embodiment also comprises an interlocking unit 154 disposed between the scroll compressor unit 107 and the scroll expansion unit 121. The interlocking unit 154 comprises scroll gears 141 and 142 which are ring gears attached to the base plates 116 and 119 of the scroll compressor unit 107, scroll gears 143 and 144 secured to the base plates 129 and 132 of the scroll expansion unit 121, four intermediate gears 145, 146, 147 and 148 engaging the respective scroll gears 141 to 144, and a gear shaft 149 for interconnecting these gears 145 to 148. The gear shaft 149 is supported by the housing 101 through bearings 150, 151 and 152 and has one end extended to the exterior of the housing 101 to be connected to a starter 153. The interlocking unit 154 enables four scrolls 113, 114, 127 and 128 to be smoothly rotated in synchronization with each other.

In the internal combustion engine thus constructed, the scroll compressor unit 107 and the scroll expansion unit 121 can be rotated by means of the starter 153 through the interlocking unit 154. Then, the scroll compressor unit 107 sucks the air-fuel mixture gas into the compressor unit chamber 104 through the intake port 103. The air-fuel mixture gas flows into the compression chamber 112 through the inlet 110 of the scroll compressor unit 107 and it is moved toward the central portion of the scroll and compressed as the scroll 12 rotates and, when it is sufficiently compressed, it reaches the central outlet 111 and pushes open the check valve 140 by its pressure to passes through the communication passage 139 into the inlet 144 of the scroll expansion unit 121. The compressed air-fuel mixture is then detonated by the ignition plug 135 to abruptly expand and increase it pressure. This pressure is not allowed to flow back through the communication passage 139 because of the check valve 140, so that it acts on the scroll members 130 and 133 of the scroll expansion unit 121 to push and increase the volume of the expansion chamber 126. The scroll expansion unit 121 is driven to rotate by the drive power of this expanding gas. One portion of this driving power is utilized to drive the scroll compression unit 107 through the third scroll 127 and the rotating shaft 118 and the interlocking unit 154, and the remaining portion of the driving power is taken out as a rotating output power from the output rotary shaft 131 of the fourth scroll 128. The expanded gas radially outwardly moved within the scroll expansion unit 121 from its center is exhausted into the expansion unit chamber 106 through the outlet 125 and then to the engine exterior through the exhaust port 105.

In this embodiment also, the pressure characteristics relative to rotational angle and pressure characteristics relative to volume as viewed in terms of the working fluid of the internal combustion engine as well as the expansion chamber torque characteristics relative to rotational angle are as illustrated in the graphs of FIGS. 6 to 8, respectively, so that torque fluctuation of the scroll compressor unit and the output torque fluctuation are small and a very smooth output torque is obtained. Since the scrolls in this embodiment are rotary type, the counter weights 40 required in the previous embodiment are not necessary, whereby the engine structure is much simpler and lighter than that of the previous embodiment.

Figure 9:
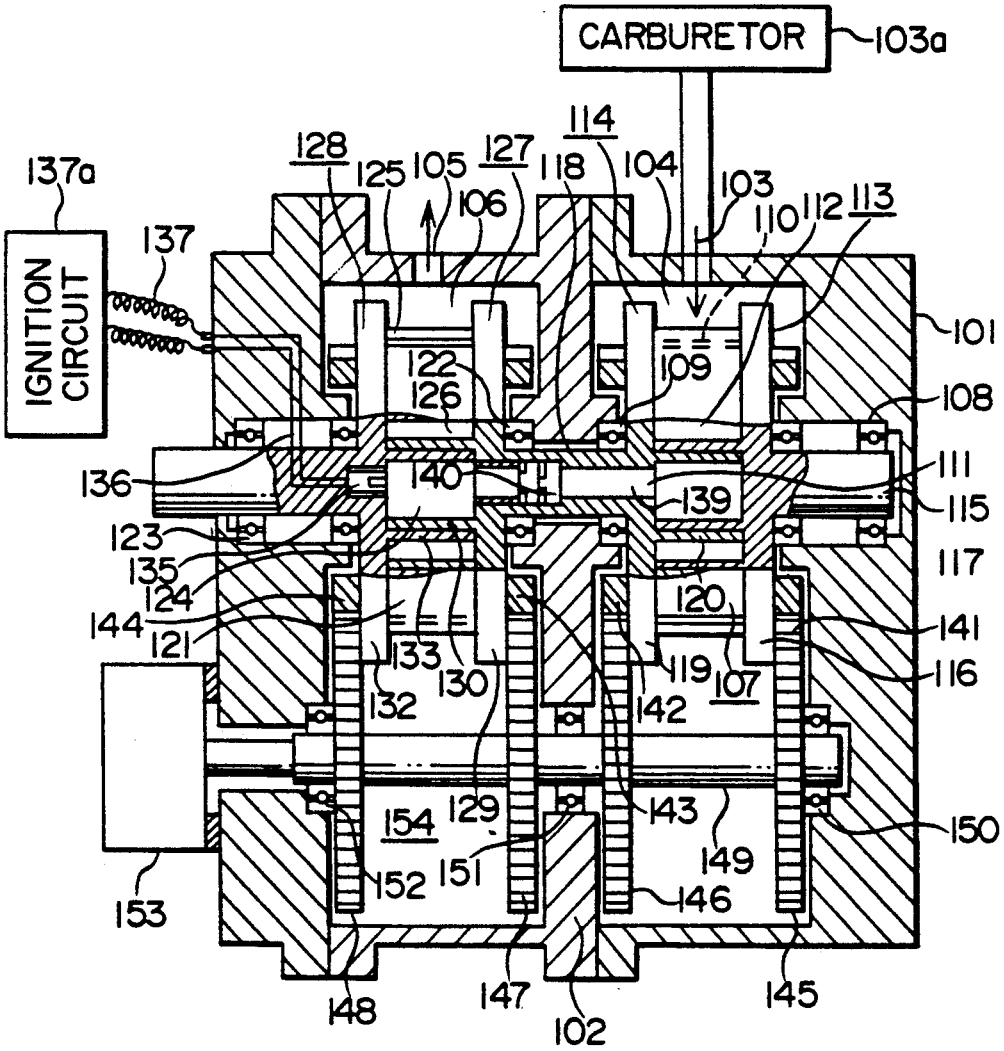
FIG. 9 is a schematic sectional view illustrating the rotary scroll-type internal combustion engine of another embodiment of the present invention.
Figure 10:
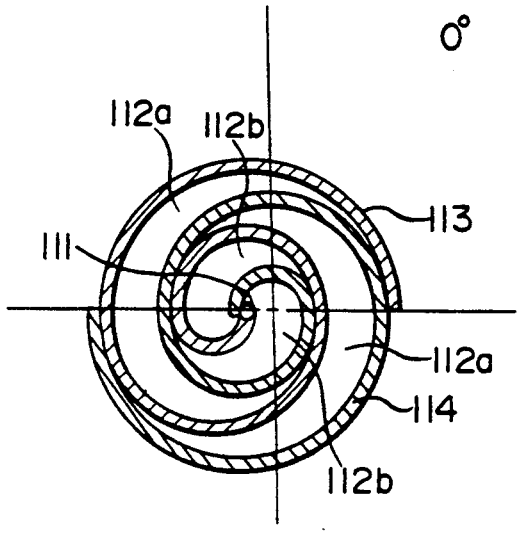
FIG. 10 is an operational diagram illustrating the scroll compressor unit shown in FIG. 9 at the initial stage of the compression stroke.
Figure 11:
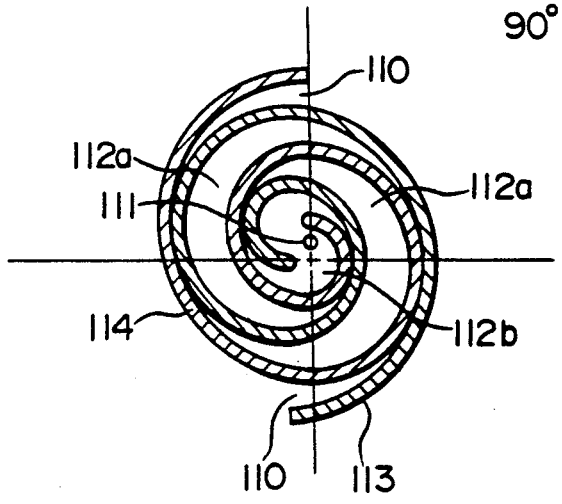
FIG. 11 is an operational diagram illustrating the scroll compressor unit rotated by 90° from the position shown in FIG. 10.
Figure 12:
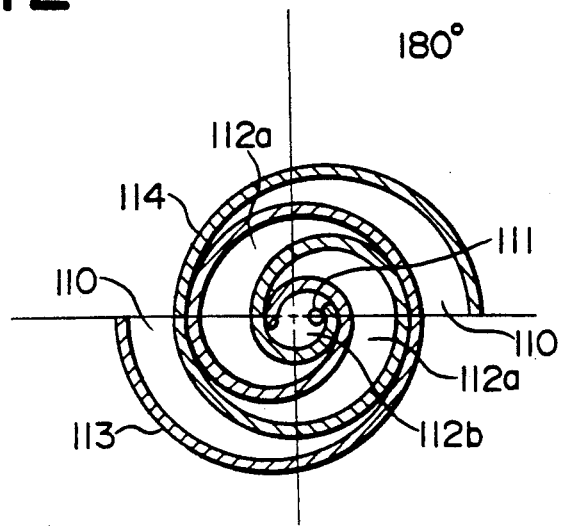
FIG. 12 is an operational diagram illustrating the scroll compressor unit rotated by 180° from the position shown in FIG. 10.
Figure 13:
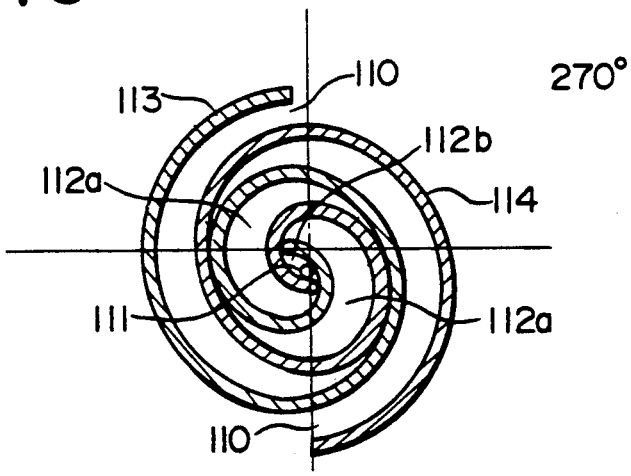
FIG. 13 is an operational diagram illustrating the scroll compressor unit rotated by 270° from the position shown in FIG. 10.

While the embodiment illustrated in FIG. 9 utilizes the scroll compressor unit 107 and the scroll expansion unit 121 of which the first and the second scrolls 113 and 114 as well as the third and the fourth scrolls 127 and 128 are respectively driven by the respective interlocking gears 145 to 148, some of the scrolls of the scroll compressor unit 107 and the scroll expansion unit 121 may be operated to be used as a driving scroll and the other of the scrolls may be used as a driven scrolls which is driven by the driving scrolls.

Figure 14:
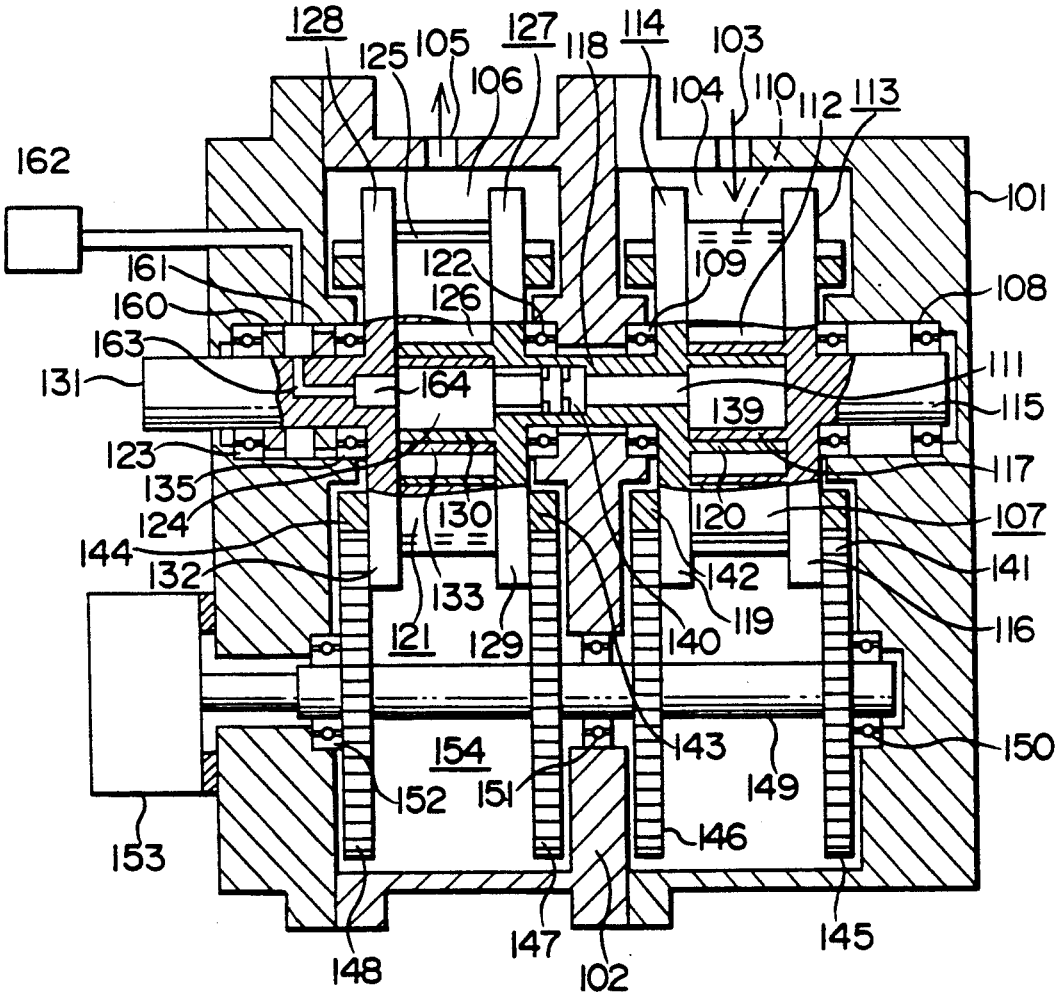
FIG. 14 is a schematic diagram illustrating another embodiment of the rotary scroll-type internal combustion engine of the present invention which is applied to the Diesel engine.

FIG. 14 illustrates an embodiment in which the rotary scroll-type internal combustion engine is applied to Diesel engine. Comparing this internal combustion engine with that shown in FIG. 9, it is understood that the ignition plug is removed from the rotary shaft 115 and a fuel injection valve 164 is provided instead. More particularly, the arrangement is such that the housing 101 is provided with a fuel pump 162 so that the fuel is supplied to the fuel supply passage 163 in the rotary shaft 115 through an annulus formed around the rotary shaft 115 by means of seal rings 160 and 161 and is injected from the fuel injection valve 164 into the expansion chamber 126. In other respects, the structure is identical to that of the previous embodiment described in conjunction with FIGS. 9 to 13. Since the Diesel engine has a high compression ratio such as 1 to 20 for example and the compressed air supplied to the expansion chamber 126 is at a very high temperature and high pressure as is well known, the compressed air supplied to the expansion chamber 126 is at a very high temperature and high pressure as is well known, the fuel is immediately detonated as soon as it is injected from the fuel injection valve 164 into the expansion chamber 126 to initiate the expansion stroke. The operational cycle in this case is also similar to those illustrated in FIG. 6 to 8.

As has been described, according to the present invention, a scroll-type internal combustion engine is realized, so that a compact, high-speed and high-efficiency internal combustion engine can be obtained.

What is claimed is:

1. An internal combustion engine comprising:

a scroll compressor unit having a pair of scrolls interfitted to each other to define a compression chamber therebetween, each of said scrolls of said scroll compressor unit comprising a rotary shaft for rotatably mounting said pair of scrolls of said scroll compressor unit;

a scroll expansion unit having a pair of scrolls interfitted to each other to define an expansion chamber therebetween, a check valve for communicating said compression chamber to said expansion chamber and a burning unit for detonating in said expansion chamber a fuel together with a working fluid to expand it thereby driving said scroll expansion unit, each of said scrolls of said scroll expansion unit comprising a rotary shaft for rotatably mounting said pair of scrolls of said scroll expansion unit; and an interconnecting unit for interconnecting said scroll compressor unit and said scroll expansion unit, wherein said interconnecting unit comprises a scroll gear secured to each of said scrolls of said scroll compressor unit and said scroll expansion unit, interconnecting gears engaging with said scroll gears, and a gear shaft connecting said interconnecting gears, thereby to synchronize rotation of all said scrolls.

2. An internal combustion engine as claimed in claim 1, wherein said scroll compressor unit and said scroll expansion unit are coaxially arranged to rotate in the same direction.

3. An internal combustion engine as claimed in claim 1, wherein said scroll on the outlet side of said scroll compressor unit and said scroll on the inlet side of said scroll expansion unit are integrally connected to each other.

4. An internal combustion engine as claimed in claim 1, wherein one of said scrolls of said scroll compressor unit and one of said scrolls of said scroll expansion unit are integrally connected in a back-to-back relationship, and the other of said scrolls of said scroll compressor unit and the other of said scrolls of said expansion unit are arranged in an opposing relationship.

5. An internal combustion engine as claimed in claim 1, wherein said scroll expansion unit has a larger number of turns of scroll than said scroll compressor unit.

6. An internal combustion engine comprising:

a rotary-type scroll compressor unit having a pair of rotatable scrolls relatively rockably interfitted to each other to define a compression chamber therebetween, each of said scrolls of said scroll compressor unit comprising a rotary shaft for rotatably mounting said pair of scrolls of said scroll compressor unit;

a rotary-type scroll expansion unit having a pair of rotatable scrolls relatively rockably interfitted to each other to define an expansion chamber therebetween, a check valve for communicating said compression chamber to said expansion chamber and a burner unit for detonating in said expansion chamber a fuel together with a working fluid to expand it thereby driving said rotary-type scroll expansion unit, each of said scrolls of said scroll expansion unit comprising a rotary shaft for rotatably mounting said pair of scrolls of said scroll expansion unit; and an interconnecting unit for interconnecting said scroll compressor unit and said scroll expansion unit, wherein said interconnecting unit comprises a scroll gear secured to each of said scrolls of said scroll compressor unit and said scroll expansion unit, interconnecting gears engaging with said scroll gears, and a gear shaft connecting said interconnecting gears, thereby to synchronize rotation of all said scrolls.

7. An internal combustion engine comprising:

a scroll compressor unit having a pair of scrolls interfitted to each other to define a compression chamber therebetween for compressing a working fluid to provide a high-temperature compressed working fluid, each of said scrolls of said scroll compressor unit comprising a rotary shaft for rotatably mounting said pair of scrolls of said scroll compressor unit;

a scroll expansion unit having a pair of scrolls interfitted to each other to define an expansion chamber communicated to said compression chamber through a check valve for receiving the high-temperature compressed working gas and a fuel injection unit for injecting fuel in the expansion chamber to detonate and expand the high-temperature compressed working gas, thereby to relatively rock said scroll expansion unit, each of said scrolls of said scroll expansion unit comprising a rotary shaft for rotatably mounting said pair of scrolls of said scroll expansion unit; and an interconnecting unit for interconnecting said scroll compressor unit and said scroll expansion unit, wherein said interconnecting unit comprises a scroll gear secured to each of said scrolls of said scroll compressor unit and said scroll expansion unit, interconnecting gears engaging with said scroll gears, and a gear shaft connecting said interconnecting gears, thereby to synchronize rotation of all said scrolls.

* * * * *